US009121313B2

(12) United States Patent
Den Dopper

(10) Patent No.: US 9,121,313 B2
(45) Date of Patent: Sep. 1, 2015

(54) SYSTEM AND METHOD FOR MONITORING BLOW-BY IN A COMBUSTION ENGINE

(75) Inventor: Jasper Den Dopper, Hooge Zwaluwe (NL)

(73) Assignee: DAF TRUCKS N.V., Eindhoven (NL)

( * ) Notice: Subject to any disclaimer, the term of this patent is extended or adjusted under 35 U.S.C. 154(b) by 86 days.

(21) Appl. No.: 13/821,901

(22) PCT Filed: Sep. 8, 2011

(86) PCT No.: PCT/NL2011/050616

§ 371 (c)(1),
(2), (4) Date: Oct. 1, 2013

(87) PCT Pub. No.: WO2012/036547

PCT Pub. Date: Mar. 22, 2012

(65) Prior Publication Data

US 2014/0053818 A1 Feb. 27, 2014

(30) Foreign Application Priority Data

Sep. 8, 2010 (NL) ..... 2005327

(51) Int. Cl.
*F01M 13/02* (2006.01)
*F01M 13/00* (2006.01)
*F01M 13/04* (2006.01)

(52) U.S. Cl.
CPC ..... *F01M 13/00* (2013.01); *F01M 13/02* (2013.01); *F01M 13/022* (2013.01); *F01M 13/04* (2013.01); *F01M 2013/026* (2013.01); *F02D 2250/08* (2013.01)

(58) Field of Classification Search
CPC ..... F01M 13/00; F01M 2013/0077; F01M 13/023; F01M 13/02
See application file for complete search history.

(56) References Cited

U.S. PATENT DOCUMENTS

2003/0233932 A1* 12/2003 Ekeroth ..... 95/12
2006/0260305 A1 11/2006 Ishiwatari
2009/0223496 A1 9/2009 Borgstrom et al.

FOREIGN PATENT DOCUMENTS

DE 20302824 U1 7/2004
WO 2009/116897 A1 9/2009

OTHER PUBLICATIONS

International Search Report—PCT/NL2011/050616—Mailing Date: Nov. 21, 2011.
International Preliminary Report on Patentability—PCT/NL2011/050616—Date of issuance: Mar. 12, 2013.

* cited by examiner

*Primary Examiner* — Lindsay Low
*Assistant Examiner* — Jacob Amick
(74) *Attorney, Agent, or Firm* — Banner & Witcoff, Ltd.

(57) ABSTRACT

A combustion engine comprises a suction valve system for discharging blow-by gas from the crankcase into an air inlet channel for the cylinders. The suction valve system is driven by an electromotor which is connected to a power source. The system comprises a rev counter which measures the rpm of the suction valve system, as well as a control unit which is connected to the power source, the rev counter and the engine management system. The control unit can set predefined engine conditions as well as the power flowing to the suction valve system to have this system rotate at a predefined speed. The value of the set power is a measurement for the blow-by. In lieu of regulating the power flowing to the suction valve system, the control unit can also set the power flowing to the suction valve system to a predefined value. The rev counter then measures the rpm of the suction valve system, which is a measurement for the blow-by.

4 Claims, 1 Drawing Sheet

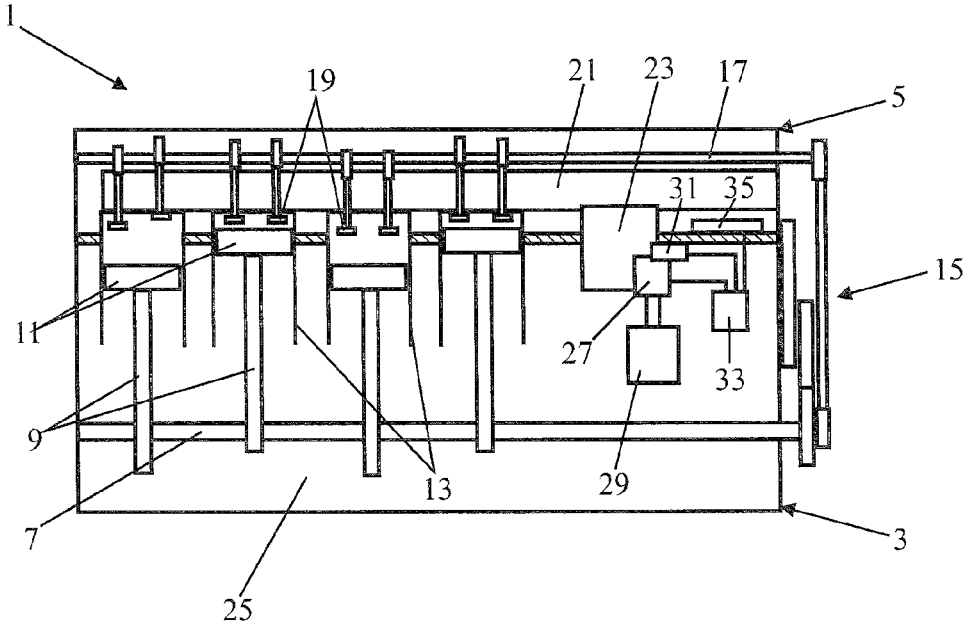
1
19
21
23
17
5
31
35
15
11
27
33
9
13
29
7
3
25

SYSTEM AND METHOD FOR MONITORING BLOW-BY IN A COMBUSTION ENGINE

CROSS-REFERENCE TO RELATED APPLICATIONS

This application is a U.S. National Stage application under 35 U.S.C. §371 of International Application PCT/NL2011/050616 (published as WO 2012/036547 A1), filed Sep. 8, 2011, which claims priority to Application NL 2005327, filed Sep. 8, 2010. Benefit of the filing date of each of these prior applications is hereby claimed. Each of these prior applications is hereby incorporated by reference in its entirety.

FIELD OF THE INVENTION

The invention relates to a system for monitoring blow-by in a combustion engine, which comprises a suction valve system which is present between the crankcase and the air intake, as well as a power source which is connected to the suction valve system. Blow-by occurs when fuel, air and moisture are forced past the piston rings into the crankcase as a result of the explosion in the cylinders of a combustion engine. This occurs owing to wear of the piston rings and cylinder liner. Also soot and pollution deposits on the piston rings and cylinder liner owing to incomplete combustion lead to an increase of blow-by. When blow-by increases, it will lead to a decrease of the power of the combustion engine because less pressure is built up in the cylinders. As a result, fuel consumption will rise. Furthermore, the crankcase oil is contaminated more when blow-by increases, which may lead to a damaged engine.

STATE OF THE ART

A combustion engine comprising a system for suction of blow-by gas from the crankcase into the air intake channel is known from NL-A-1032942.

SUMMARY OF THE INVENTION

It is an object of the invention to provide a system for monitoring the amount of blow-by in a combustion engine so as to take preventive measures before the wear caused by blow-by can lead to damage to the engine. For this purpose the system according to the invention is characterised in that the system further comprises a rev counter which measures the rpm value of the suction valve system, as well as a control unit which is connected to the power source, the rev counter and the combustion engine and which is capable of setting predefined engine conditions and also the power flowing to the suction valve system so as to have the suction valve system rotate at a predefined speed. The amount of power is a measure for the amount of blow-by.

The system according to the invention can also be used for monitoring by means of On-Board Diagnostics (OBD) the hose between a presuction valve and a main suction valve of the suction valve system for crevices or leakage owing to improper mounting.

Another system for monitoring blow-by in a combustion engine is characterised in that the system further comprises a rev counter which measures the rpm of the suction valve system, as well as a control unit which is connected to the power source, the rev counter and the combustion engine and which is capable of setting predefined engine conditions and also the power flowing to the suction valve system to a predefined value, where the rev counter measures the rpm of the suction valve system. The value of the rpm is a measurement for the amount of blow-by.

The invention also relates to a method of monitoring blow-by in a combustion engine. With respect to the method the invention is characterised in that predefined engine conditions are set and power flowing to a suction valve system is regulated until the suction valve system rotates at a predefined speed, subsequent to which the amount of the power is compared to that measured during a previous measurement. When the power increases so does the blow-by.

Another method according to the invention of monitoring blow-by is characterised in that predefined engine conditions are set and so is the predefined amount of power flowing to the suction valve system, where the rpm of the suction valve system is measured and compared to that of a previous measurement. When the speed drops, there is mention of an increase of blow-by.

BRIEF DESCRIPTION OF THE DRAWING

The invention will be elucidated more fully below based on an example of embodiment of the system according to the invention while reference is made to the appended drawing FIGURE, in which FIG. 1 shows a sectional view of a combustion engine equipped with an embodiment of the system according to the invention.

DETAILED DESCRIPTION OF THE DRAWING

FIG. 1 shows a sectional view of a combustion engine equipped with an embodiment of the system according to the invention. The combustion engine 1 comprises an engine block 3 and a cylinder head 5. Inside the engine block a crankshaft 7 is supported on a bearing and driven via driving rods 9 by pistons 11 moving in cylinders 13. Via a transmission 15 the crankshaft 7 drives a camshaft 17 supported on a bearing in the cylinder head 5. This camshaft opens and closes valves 19 present in the cylinder head. An air inlet channel 21 is also present in the cylinder head.

The combustion engine 1 further includes a suction valve system 23 for discharging blow-by gas from the crankcase 25 into the air inlet channel 21. The suction valve system 23 is driven by an electromotor 27 which is connected to a power source 29. The suction valve system comprises a rev counter 31 which measures the rpm of the suction valve system, as well as a control unit 33 which is connected to the power source, the rev counter and an engine management system 35. The control unit 33 can set predefined engine conditions as well as the power flowing to the suction valve system 23 so as to have this system rotate at a predefined speed. The value of the set power is a measurement for the blow-by.

In lieu of regulating the power flowing to the suction valve system, the control unit can also set the power flowing to the suction valve system to a predefined value. The rev counter then measures the rpm of the suction valve system, which is a measurement for the blow-by.

Albeit the invention has been described in the foregoing with reference to the drawing, it should be pointed out that the invention is not by any manner or means restricted to the embodiments shown in the drawings. The invention also extends over any embodiment deviating from the embodiment shown in the drawing FIGURE within the spirit and scope defined by the claims.

The invention claimed is:

1. A system for monitoring blow-by in a combustion engine which comprises a suction device which is positioned between a crankcase and an air intake a power source which is connected to an electric motor driving the suction device, as well as a control unit which is connected to the power source, wherein the system further comprises a revolution counter which measures the rotation speed of the suction device, wherein the control unit is connected to the power source, the revolution counter, and the combustion engine, wherein the control unit is capable of setting predefined engine conditions and also power the suction device so as to have the suction device rotate at a predefined speed, and wherein the control unit is arranged to compare an amount of power to the suction device with a previously measured amount of power.

2. A system for monitoring blow-by in a combustion engine which comprises a suction device which is positioned between a crankcase and an air intake, a power source which is connected to an electric motor driving the suction device, as well as a control unit which is connected to the power source, wherein the system further comprises a revolution counter which measures the rotation speed of the suction device, wherein the control unit is further connected to the revolution counter, and the combustion engine, wherein the control unit is capable of setting predefined engine conditions and also power to the suction device to a predefined value, wherein the revolution counter measures the rotation speed of the suction device, and wherein the control unit is arranged to compare the rotation speed of the suction device with a previously measured rotation speed.

3. A method of monitoring blow by using the system of claim 1, wherein predefined engine conditions are set and power to a suction device is regulated until the suction device rotates at a predefined speed, subsequent to which an amount of power is compared to that measured during a previous measurement.

4. A method of monitoring blow-by using the system of claim 2, wherein predefined engine conditions are set and a predefined amount of the power to the suction device is set, wherein the rotation speed of the suction device is measured and compared to that of a previous measurement.

* * * * *